United States Patent [19]

Wakabayashi et al.

[11] Patent Number: 4,501,314

[45] Date of Patent: Feb. 26, 1985

[54] CASTING SUPPORT APPARATUS FOR CONTINUOUS CASTING EQUIPMENT

[75] Inventors: Masaru Wakabayashi, Osaka; Kuniaki Ono, Nara, both of Japan

[73] Assignee: Hitachi Shipbuilding & Engineering Ltd., Osaka, Japan

[21] Appl. No.: 576,779

[22] Filed: Feb. 3, 1984

Related U.S. Application Data

[63] Continuation of Ser. No. 372,946, Apr. 29, 1982, abandoned.

[51] Int. Cl.[3] ..... B22D 11/124; B22D 11/12

[52] U.S. Cl. ..... 164/441; 164/442; 164/444

[58] Field of Search ..... 164/441, 442, 484, 444

[56] References Cited

U.S. PATENT DOCUMENTS

| | | | |
|---|---|---|---|
| 3,015,862 | 1/1962 | Rustemeyer et al. | 164/441 X |
| 3,654,989 | 4/1972 | Meier et al. | 164/441 X |
| 3,766,968 | 10/1973 | Fortner et al. | 164/442 |
| 3,989,093 | 11/1976 | Peitl et al. | 164/442 |

FOREIGN PATENT DOCUMENTS

| | | | |
|---|---|---|---|
| 1809471 | 6/1970 | Fed. Rep. of Germany | 164/442 |
| 56-6195 | 2/1981 | Japan . | |

*Primary Examiner*—Kuang Y. Lin

*Attorney, Agent, or Firm*—Joseph W. Farley

[57] ABSTRACT

A casting support apparatus comprising pairs of opposed separate cooling plates arranged in an upper stage immediately below a mold and each having grooves in its surface; pairs of opposed separate cooling plates arranged in a lower stage immediately below the upper stage cooling plates and each having grooves in its surface; a plurality of cooling rolls each rotatably provided in a space formed between each two adjacent cooling plates in each of the stages, each of the cooling rolls being formed with annular grooves along its outer periphery; jet nozzles arranged for introducing cooling water into a space between a casting and the cooling plates in each stage from above the cooling plates; jet nozzles arranged for introducing cooling water into a space between the casting and the cooling rolls in each stage from above the cooling rolls; and auxiliary jet nozzles arranged for applying cooling water to the rear surfaces of the cooling plates in each stage. The apparatus cools the casting efficiently and is easy and inexpensive to maintain.

6 Claims, 7 Drawing Figures

CASTING SUPPORT APPARATUS FOR CONTINUOUS CASTING EQUIPMENT

This is a continuation application of application Ser. No. 372,946, filed Apr. 29, 1982, now abandoned.

The present invention relates to a casting support apparatus for use in continuous casting equipment as arranged immediately below its mold for cooling a casting while supporting and guiding the same to thereby effectively solidify the surface layer of the casting.

Casting support apparatus of this type are known which comprise a plurality of pairs of opposed cooling plates arranged in a plurality of divided stages and in which each of the cooling plates is formed with grooves for causing cooling water to flow down therethrough. Such apparatus involves great frictional resistance between the cooling plates and the casting and is therefore unsuited for drawing the casting at a high speed.

Published Examined Japanese Patent Application No. 56-6195 discloses a casting support apparatus which is free of this problem and suited to high-speed continuous casting. The apparatus comprises a pair of cooling plates arranged in an upper stage immediately below a mold, a pair of cooling plates arranged in a lower stage immediately below the upper stage cooling plates, a plurality of cooling rolls each formed with annular grooves in its outer periphery and provided rotatably in an opening formed in the cooling plate, and jet nozzles for supplying cooling water to the surfaces of all the cooling plates and the cooling rolls. When there arises a need to repair one of the cooling plates of this apparatus due to local wear or defect, the defective portion only is not removable but the whole plate must be removed, so that the repairing procedure is cumbersome while the replacement of the plate, if needed, requires a high material cost. Further because no jet nozzle is provided for cooling the cooling plates from behind, the apparatus has the drawback of being low in cooling efficiency and rendering the cooling plates susceptible to damage. With these drawbacks, the apparatus is not practically useful for supporting the casting.

The object of the present invention is to overcome the above drawbacks and to provide a casting support apparatus which is useful for withdrawing a casting at a high speed, capable of solidifying the surface layer of the casting rapidly by an efficient cooling action and yet easy and inexpensive to maintain.

To fulfill this object, the present invention provides a casting support apparatus for continuous casting equipment comprising pairs of cooling plate means arranged in opposed relation to each other in divided stages immediately below a mold for guiding and supporting a casting as held between the means, each pair of the plate means being composed of pairs of separate cooling plates, each of the cooling plates having a plurality of grooves; a plurality of cooling rolls each rotatably provided in a space formed between each two adjacent cooling plates in each of the stages, each of the cooling rolls being formed with an annular groove or grooves along its outer periphery; cooling plate jet nozzles arranged for introducing a cooling fluid into a space between the casting and the cooling plates in each stage from above the cooling plates; cooling roll jet nozzles arranged for introducing a cooling fluid into a space between the casting and the cooling rolls in each stage from above the cooling rolls; and auxiliary jet nozzles arranged for applying a cooling fluid to the rear surfaces of the cooling plates in each stage.

The cooling plates in each stage of the above apparatus can be installed and removed individually and are therefore easy and inexpensive to repair or replace. Since grooves are formed in both the cooling plates and the cooling rolls, the casting can be cooled efficiently and uniformly to form a solidified surface layer within a short period of time. The jet nozzles provided for cooling the cooling plates from behind reduce the likelihood that the plates will be damaged due to insufficient cooling.

Various features and advantages of the invention will be readily understood from the embodiment to be described below with reference to the accompanying drawings, in which.

Figure 3:
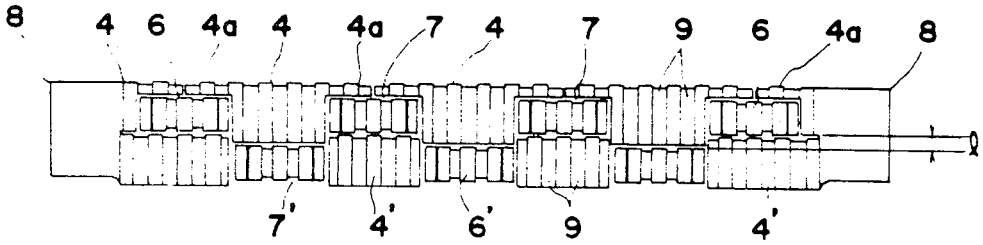
FIG. 3 is a view showing the apparatus as it is seen along the line III—III in FIG. 1.
Figure 5:
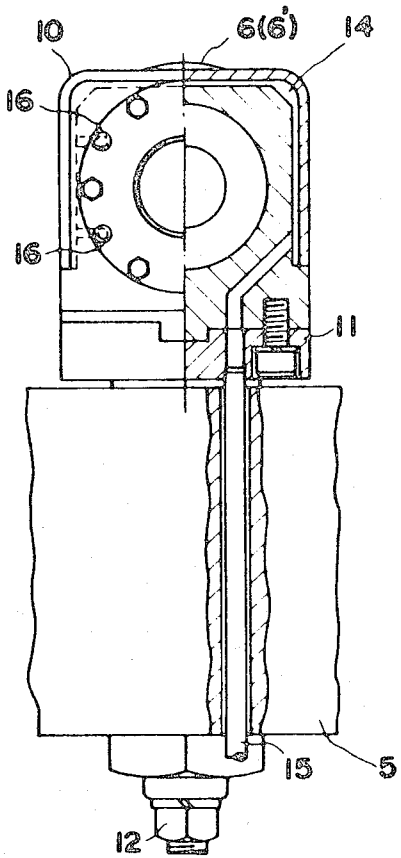
Figure 6:
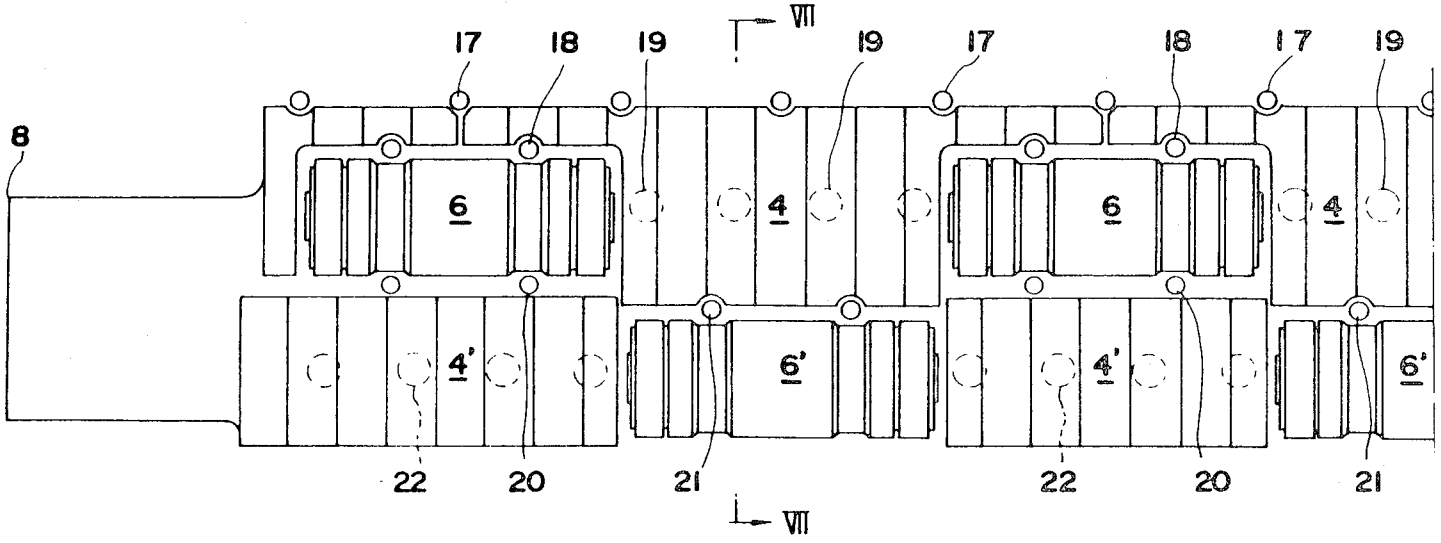
Figure 7:
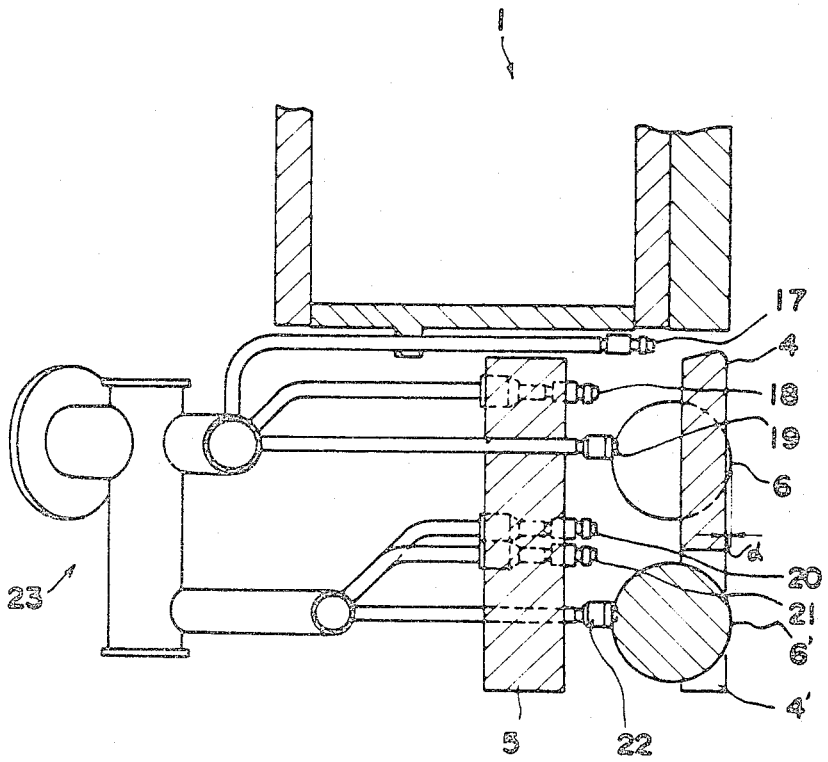

FIG. 5. is a side elevation showing the cooling roller and partly in section;

FIG. 6 is a view similar to FIG. 3 and showing an arrangement of jet nozzles; and FIG. 7 is a view in section taken along the line VII—VII in FIG. 6.

Figure 1:
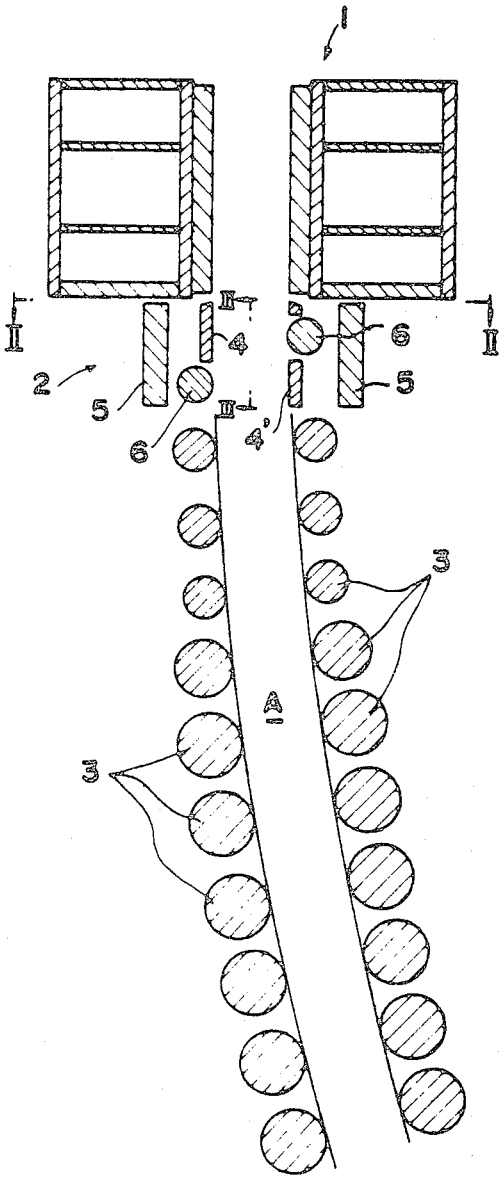
FIG. 1 is a fragmentary view showing continuous casting equipment including a casting support apparatus according to the invention, the view being in section taken along the line I—I in FIG. 2.
Figure 2:
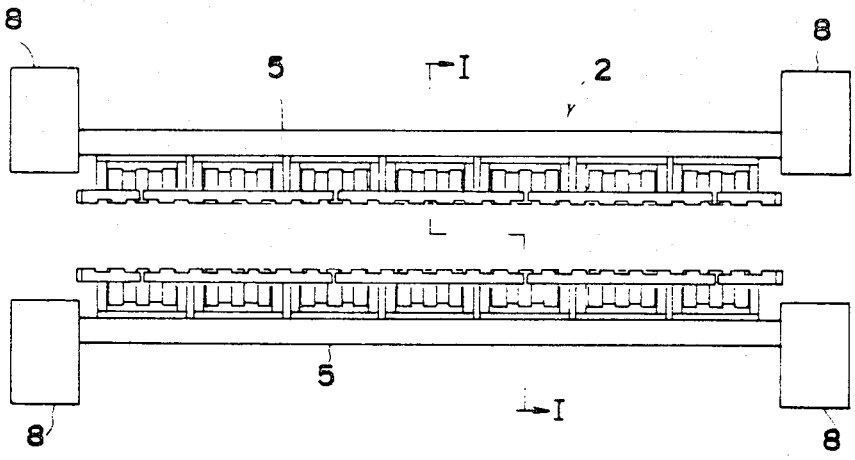
FIG. 2 is a view showing the apparatus as it is seen along the line II—II in FIG. 1.

With reference to FIGS. 1 to 3, continuous casting equipment includes a mold 1, a casting support apparatus 2 embodying the invention and disposed immediately below the mold 1, and a plurality of pairs of casting guide rolls 3 arranged subsequently. The casting A formed by the mold 1 is withdrawn at a high speed in the form of a strip through the support apparatus 2 and along the guide rolls 3.

The casting support apparatus 2 consists essentially of a plurality of pairs of cooling plates 4 arranged in an upper stage immediately below the mold 1 and fixed to back plates 5 by unillustrated bolts, a plurality of pairs of cooling plates 4' arranged in a lower stage immediately below the upper stage cooling plates 4 and similarly fixed to the back plates 5 by unillustrated bolts, cooling rolls 6 arranged in the upper stage and each provided in an installation space 7 formed between each two adjacent cooling plates 4, and cooling rolls 6' arranged in the lower stage and each provided in an installation space 7' formed between each two adjacent cooling plates 4'. Each of the back plates 5 is fixed at its opposite ends to mount blocks 8 secured to the bottom of the mold 1.

The cooling plates 4, 4' in the upper and lower stages are in the form of completely separate members and can be attached to and removed from the back plates 5 individually. Each of the cooling plates 4, 4' is formed with grooves 9. The upper stage cooling plate 4 has extensions **4*a* each positioned above the corresponding cooling roll 6. As seen in FIG. 3, the areas of cooling plates 4, 4' positioned within a region l between the group of upper stage cooling rolls 6 and the group of lower stage cooling rolls 6' are minimized to reduce the frictional resistance to be produced between the casting A and the cooling plates 4, 4' at this region. On the other hand, the upper and lower stage cooling rolls 6, 6'** are spaced apart equidistantly in a staggered arrangement with respect to the horizontal direction.

Figure 4:
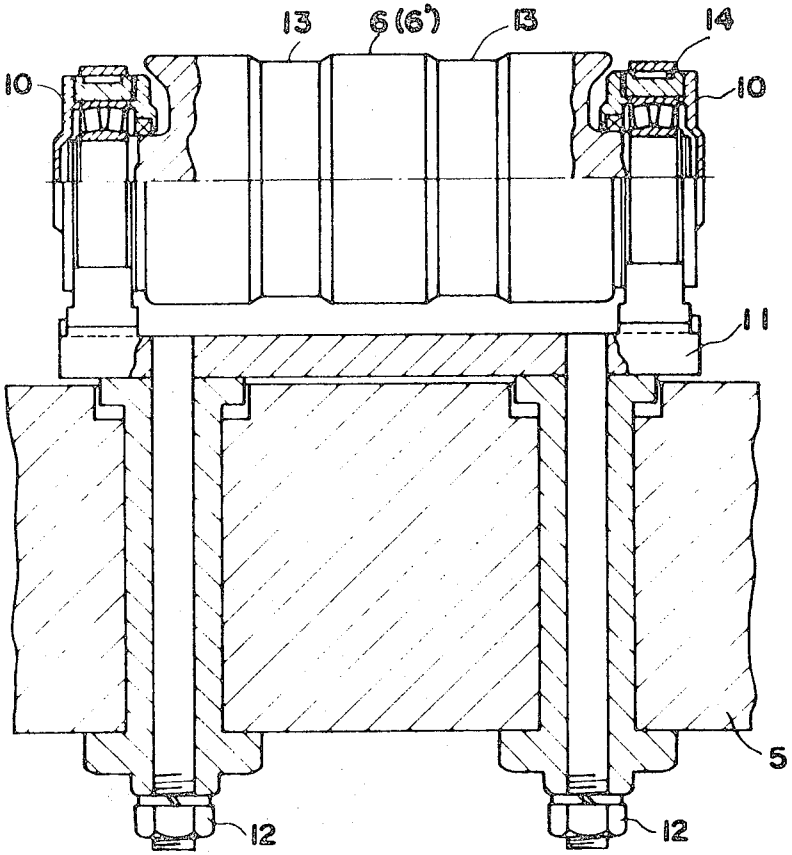
FIG. 4 is a plan view partly in section and showing a cooling roller.

With reference to FIGS. 4 and 5, each of the cooling rolls 6, 6′ is rotatably supported at its opposite ends by bearings 10 which are fixed to the back plate 5 by a mount plate 11 and bolts 12 and is formed with annular grooves 13 along its outer periphery. Each of the bearings 10 has a cooling water channel 14 in communication with a water supply pipe 15 extending through the back plate 5. The cooling water channel 14 terminates at drain ports 16 formed in the housing of the bearing. The water circulating through the bearing 10 is run off through the ports 16. The cooling roll is projected outward beyond the cooling plates adjacent thereto by a predetermined small distance $\alpha$, for example, by 1 mm (see FIG. 7).

FIGS. 6 and 7 show an arrangement of nozzles for jetting out cooling water. A row of jet nozzles 17 discharge cooling water from a space between the mold 1 and the upper stage cooling plates 4 toward the casting A to cause the water to flow down the front surfaces of the upper stage cooling plates 4. A row of jet nozzles 18 are positioned in corresponding relation to the annular grooves 13 of the upper stage cooling rolls 6 for discharging water against the casting A from between the extensions 4*a* of the upper stage cooling plates 4 and the upper stage cooling rolls 6 so that the water flows down the outer surfaces of the rolls 6. A row of jet nozzles 19 are positioned in the rear of the upper stage cooling plates 4 for cooling the plates 4 from behind. A row of jet nozzles 20, corresponding the jet nozzles 17, are provided for discharging water from between the upper stage cooling rolls 6 and the lower stage cooling plates 4′. Rows of jet nozzles 21, 22 are arranged in the illustrated positions in corresponding relation to the jet nozzles 18, 19 respectively. All the jet nozzles are connected to a water supply piping 23 in the rear of the back plate 5.

Of these nozzles, the nozzles 17, 18, 20, 21 must discharge water to the surface of the casting A through a narrow space, so that it is preferable to use as such nozzles flat nozzles which are capable of forcing out water linealy. On the other hand, full-cone nozzles for discharging water at a wide angle are used as the nozzles 19, 20 so as to uniformly cool the rear surfaces of the cooling plates 4, 4′. Although the jet nozzles of the illustrated embodiment are in an arrangement which fulfills a minimum requirement for efficient cooling, additional jet nozzles are of course usable to achieve an increased cooling efficiency.

Next, the operation of the casting support apparatus will be described. During operation, the mold 1 is in vibration, and the support apparatus fixed thereto is similarly in vibration. In this state, molten metal is poured into the mold 1, and the resulting casting A is drawn at a high speed. At this time, the casting A is supported directly by the cooling rolls 6, 6′ projecting by the specified small distance, with a bulge of the casting A merely bearing on the cooling plates 4, 4′, with the result that the resistance to the drawing of the casting A is small and will not cause any trouble to the high-speed drawing operation. Further because the areas of the cooling plates 4, 4′ positioned within the aforementioned region l (see FIG. 3) are minimized, the undesired frictional resistance between the casting A and the plates can be eliminated. The areas of the cooling plates 4, 4′ should be limited to a minimum needed for supporting the bulge of the casting A since the plates 4, 4′ exert a force acting against the drawing of the casting A especially when displaced upward by the vibration of the mold 1.

While the casting A is being drawn, the casting A and the cooling plates 4, 4′ are cooled efficiently with the water discharged from the jet nozzles. More specifically, the water from the jet nozzles 17 cools the surface of the casting A upon striking thereagainst and then flows down the grooves 9 of the upper stage cooling plates 4 to cool the plates 4. If the extensions 4*a* were not provided above the upper stage cooling rolls 6, the water would flow down through these portions where the resistance encountered is smaller in the absence of the extensions, but the presence of the extensions 4*a* permits the water to flow over the upper stage plates 4 entirely. The water from the jet nozzles 18, 21 cools the casting A and then cools the upper stage and lower stage rolls 6, 6′ respectively. The jet nozzles 19, 22 serve to cool the upper stage and lower stage plates 4, 4′ respectively from behind to compensate for the insufficiency of cooling from the front. The jet nozzles 20 act similarly to the nozzles 17.

In this way the jet nozzles 17 to 22 operate to efficiently cool the cooling plates 4, 4′, cooling rolls 6, 6′ and casting A. Although the casting A is cooled by the support apparatus 2 for a short period of time because it is drawn at a high speed, the surface of the casting A can be fully solidified even within the short period by the arrangement of the nozzles of the present embodiment.

While the cooling rolls 6 or 6′ rotate at a high speed during drawing with heat building up in the bearings 10, the rolls are rotatable free of seizure and other trouble because the bearings are cooled with water circulating through the water channels 14.

The cooling plates 4, 4′, which are separate members, are attached to the back plates 5 individually, so that where there arises the need to replace or repair one of the plates due to wear or like defect, the defective plate only may be removed. This assures maintenance with ease and at a low cost.

What is claimed is:

1. A casting support apparatus for continuous casting equipment comprising pairs of cooling plate means arranged in opposed relation to each other immediately below a mold and in successive vertically divided stages for guiding and supporting the casting as held between the pairs of plate means, said stages including an upper stage and at least one successive lower stage, each pair of plate means in each stage being composed of pairs of separate cooling plates spaced horizontally and individually detachably mounted to one of a pair of back plates, each cooling plate being provided with groove means;

a plurality of cooling rolls each rotatably mounted in a space formed between each two adjacent cooling plates in each stage, each cooling roll being formed with annular groove means on its outer periphery;

cooling plate jet nozzles arranged for introducing a cooling fluid into a space between the casting and the cooling plates in each stage from above the cooling plates;

cooling roll jet nozzles arranged for introducing a cooling fluid into a space between the casting and the cooling rolls in each stage from above the cooling rools; and auxiliary jet nozzles arranged for applying a cooling fluid to the rear surfaces of the cooling plates in each stage; each cooling plate in said upper stage being provided with extension means positioned immediately above and adjacent cooling roll in said upper stage, the upper portions of the cooling plates in each said successive lower stage being positioned immediately below the respective cooling rolls in the adjacent stage above said successive lower stage and in vertically overlapping relation with the lower portions of the cooling plates in said adjacent stage.

2. An apparatus as defined in claim 1 wherein the cooling rolls in two adjacent stages are in a staggered arrangement.

3. An apparatus as defined in claim 1 wherein the cooling plate jet nozzles and the cooling roll jet nozzles are flat nozzles, and the auxiliary jet nozzles are full-cone nozzles.

4. An apparatus as defined in claim 1 wherein the cooling roll jet nozzles are positioned in corresponding relation to the annular grooves of the cooling rolls.

5. An apparatus as defined in claim 1 wherein each of the cooling rolls is rotatably supported by a pair of bearings each having a cooling fluid channel.

6. An apparatus as defined in claim 1 wherein the outer surfaces of the cooling rolls are projected outward beyond the cooling plates by a predetermined small distance, preferably by about 1 mm.

* * * * *

UNITED STATES PATENT AND TRADEMARK OFFICE

CERTIFICATE OF CORRECTION

PATENT NO. : 4,501,314

DATED : February 26, 1985

INVENTOR(S) : Masaru Wakabayashi et al

It is certified that error appears in the above—identified patent and that said Letters Patent is hereby corrected as shown below:

Column 5, line 3, "and" should read --an--.

Signed and Sealed this

*Second* Day of *July 1985*

[SEAL]

*Attest:*

DONALD J. QUIGG

*Attesting Officer* *Acting Commissioner of Patents and Trademarks*